US006022654A

United States Patent [19]

Nakayama et al.

[11] Patent Number: 6,022,654

[45] Date of Patent: Feb. 8, 2000

[54] PRODUCTION PROCESS OF LITHOGRAPHIC PRINTING PLATE

[75] Inventors: Takao Nakayama; Shigeyuki Dan; Ryosuke Itakura; Hideyuki Hattori; Hiroshi Tashiro, all of Shizuoka, Japan

[73] Assignee: Fuji Photo Film Co., Ltd., Kanagawa, Japan

[21] Appl. No.: 09/168,135

[22] Filed: Oct. 7, 1998

[30] Foreign Application Priority Data

| | | | |
|---|---|---|---|
| Dec. 28, 1996 | [JP] | Japan | 8-358409 |
| Jan. 31, 1997 | [JP] | Japan | 9-33353 |
| Oct. 7, 1997 | [JP] | Japan | 9-290456 |

[51] Int. Cl.[7] ..... G03G 13/02

[52] U.S. Cl. ..... 430/31; 430/49; 430/902

[58] Field of Search ..... 430/31, 902, 49

[56] References Cited

U.S. PATENT DOCUMENTS

| | | | |
|---|---|---|---|
| 3,038,073 | 6/1962 | Johnson | 430/902 |
| 3,626,260 | 12/1971 | Kimura et al. | 430/902 |
| 3,762,811 | 10/1973 | Matsumoto | 430/902 |

FOREIGN PATENT DOCUMENTS

| | | | |
|---|---|---|---|
| 3817249 | 9/1960 | Japan . | |
| 412426 | 3/1962 | Japan . | |
| 4112432 | 12/1962 | Japan . | |
| 867834 | 5/1961 | United Kingdom | 430/902 |

*Primary Examiner*—Roland Martin
*Attorney, Agent, or Firm*—McAulay Nissen Goldberg Kiel & Hand, LLP

[57] ABSTRACT

Disclosed is a process for producing a lithographic printing plate using a lithographic printing plate precursor comprising a support having a volume resistivity of more than $1\times10^{10}$ Ω.cm, an electrically conductive layer provided on one surface of the support and having a volume resistivity of $1\times10^{5}$ Ω.cm or less and a photoconductive layer provided on the electrically conductive layer and containing zinc oxide and a binder, the process comprising applying negative corona discharge to the lithographic printing plate precursor from the photoconductive layer side and at this discharging, contacting an electric conductor having an earth potential at least with the support of the lithographic printing plate precursor to electrically charging the photoconductive layer of the lithographic printing plate precursor.

8 Claims, 2 Drawing Sheets

PRODUCTION PROCESS OF LITHOGRAPHIC PRINTING PLATE

FIELD OF THE INVENTION

The present invention relates to a production process of a lithographic printing plate, more specifically, the present invention relates to a process for producing a lithographic printing plate using an electrophotographic system, which is prevented from uneven electrostatic charging and capable of obtaining a good toner image reduced in fog.

BACKGROUND OF THE INVENTION

Heretofore, for manufacturing a lithographic printing plate by an electrophotographic system, a lithographic printing plate precursor comprising a water resistant support having provided thereon a layer containing zinc oxide and a binder is subjected to corona electrical charging, imagewise exposed, toner-developed, fixed and then etched.

Examples of the water resistant support include waterproofed paper, waterproofed metal foil and a composite material thereof.

When paper is used as the support, in order to impart electrical conductivity to the paper, a coating solution containing an inorganic electrolyte such as sodium chloride, potassium chloride or calcium chloride, or an organic polyelectrolyte such as quaternary ammonium, which are called an electrically conducting agent, is used and the paper is dipped therein or coated with the solution. At this time, the volume resistivity of the paper is adjusted to about $1\times10^9$ Ω.cm.

However, when a lithographic printing plate precursor is manufactured using paper subjected to electrical conductivity treatment as the base material, due to the fountain solution applied during the printing, the paper on a roll at the printing cannot evade partial elongation, namely, plate elongation. As a result, wrinkles may be generated on the plate during the printing or the printed matter may be out of register to cause troubles such as geometric distortion of ruled lines.

In order to prevent the adverse effect of the fountain solution, JP-A-58-57994 (the term "JP-A" as used herein means an "unexamined published Japanese patent application") and JP-A-59-64395 describe a structure where a laminate layer such as polyethylene containing an electrically conductive filler is provided. That is, use of an electrically conductive laminated paper has been attempted.

This laminated paper is, however, disadvantageous in that the paper support or resin film must be treated to have electrical conductivity, the production cost for the support increases and in turn, the cost of the printing plate as a whole increases.

Furthermore, for example, JP-B-38-17249 (the term "JP-B" as used herein means an "examined Japanese patent publication"), JP-B-41-2426 and JP-B-41-12432 describe an attempt to use a paper having laminated thereon a metal foil such as aluminum, zinc or copper (hereinafter referred to as a "metal foil-laminated paper"). For the paper to be laminated in this case, the above-described paper impregnated with an electrically conducting agent is also used.

When this metal foil-laminated paper is used, the paper is necessary to be treated to have electrical conductivity and moreover, a metal foil must be laminated on one or both surfaces of the paper. Thus, the production cost is disadvantageously higher than that for the above-described laminated paper.

In this case, it may be considered to use a support obtained by forming an electrically conductive layer such as a metal foil on a normal polyester base or polyethylene-laminated paper base and further forming thereon a photoconductive layer. Such a support is inexpensive but on the other hand, the support as a whole is low in the electrical conductivity and cannot be used in practice. This is more specifically described below.

In the electrophotographic system, the lithographic printing plate is usually manufactured by the plate-making process where, as shown in FIG. 4, corona electrical charge is applied on both surfaces of a plate precursor In FIG. 4, a master 1' is passed through a negative corona charger 12 and a positive corona charger 19 before entering the exposure part 20, so that the upper part and the lower part of the photoconductive layer are charged to – and +, respectively, and then imagewise exposed at the exposure part 20. As a result, the electric charge in the exposed area is lost due to conduction of the photoconductive layer and the electric charge remains only in the non-exposed area to form an electrostatic image.

According to the print-making process having a construction as shown in FIG. 4, however, if the support is low in the electrical conductivity, the discharge phenomenon does not successfully occur and the image is deteriorated. It may be considered to directly contacting an electric conductor with the electrical conductive layer to earth and charge it, but since the lithographic printing plate is not repeatedly used and a new plate is always used, in view of the mechanism, an electric conductor is difficult to be contacted with the electrically conductive layer between the support and the photoconductive layer.

In the print-making process shown in FIG. 4, the exposure light irradiated from a light source is converged by a lens 18 at the exposure part 20. The exposure light converged forms an image on the master 1' which is fed from the paper feeding part 11 by a transportation means, subjected to electrostatic charging treatment and present in the exposure area 20 between guide rollers 15 and 16, thereby performing imagewise exposure or the master 1'. The exposed master 1' is transported to the development/fixing part 17 by the transportation means, developed by attaching toner to the non-exposed area, fixed, degreased, and dried to produce a lithographic printing plate.

SUMMARY OF THE INVENTION

The object of the present invention is to provide a production process of a lithographic printing plate which is inexpensive, free of plate elongation, easy to handle and capable of obtaining a uniform image.

The above-described object can be attained by a process for producing a lithographic printing plate using a lithographic printing plate precursor comprising a support having a volume resistivity of more than $1\times10^{10}$ Ω.cm, an electrically conductive layer provided on one surface of the support and having a volume resistivity of $1\times10^5$ Ω.cm or less and a photoconductive layer provided on the electrically conductive layer and containing zinc oxide and a binder, the process comprising applying negative corona discharge to the lithographic printing plate precursor from the photoconductive layer side and at this discharging, contacting an electric conductor having an earth potential at least with the support of the lithographic printing plate precursor to electrostatically charge the photo-conductive layer of the lithographic printing plate precursor.

The present inventors have found that even when the support itself has a volume resistivity as low as more than $1\times10^{10}$ Ω.cm, by providing an electrically conductive layer between the support and a photoconductive layer and contacting an electric conductor having an earth potential with the back surface of the support to cause discharging therebetween, necessary electrostatic charge can be obtained. The present invention has been accomplished based on this findings.

DETAILED DESCRIPTION OF THE INVENTION

Figure 1:
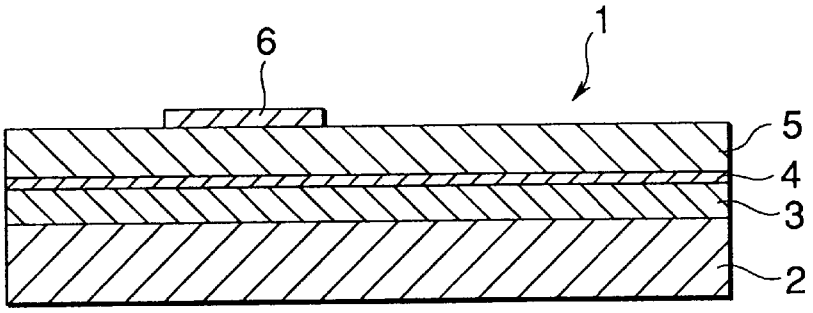
FIG. 1 is a conceptual view showing the structure of a lithographic printing plate according to the present invention.

In the production process of a lithographic printing plate of the present invention, a lithographic printing plate precursor comprising a support having water resistance and a volume resistivity of more than $1\times10^{10}$ Ω.cm, an electrically conductive layer provided on one surface of the support and having a volume resistivity of $1\times10^{5}$ Ω.cm or less and a photoconductive layer provided on the electrically conductive layer and containing zinc oxide and a binder is used. Negative corona discharge is applied to the lithographic printing plate precursor from the photoconductive layer side and at the discharging, an electric conductor having an earth potential is contacted at least with the support of the lithographic printing plate precursor to electrostatically charging the lithographic plate precursor. The term "support" as used herein means an element assembly such as laminated paper or resin material, exclusive of a photosensitive layer, a blocking layer, a conductive layer and a backcoat layer which are described later.

Examples of the support having a resistivity of more than $1\times10^{10}$ Ω.cm include polyamide, polyolefin, an ethyl acrylate-ethyl methacrylate copolymer, an acrylonitrile-methyl methacrylate copolymer, amylose acetate, a styrene-butadiene copolymer, polycarbonate, polyvinyl formate, poly-p-chlorostyrene, polyvinyl acetate, polydimethylsiloxane, polystyrene, polethyl acrylate, polyacrylonitrile, polyacenaphthylene, 1,4-polyisoprene, poly-p-isopropylstyrene, polyethylene terephthalate, polyethylene naphthalate, polyethylene, polyvinyl chloride, polyoxymethylene, polypropylene oxide, polyisobutyl methacrylate, polyethyl methacrylate, poly-2-ethylbutyl methacrylate, poly-n-butyl methacrylate, polymethyl methacrylate, poly-n-lauryl methacrylate, poly-a-methylstyrene, poly-p-methylstyrene, poly-o-methoxystyrene, poly-p-methoxystyrene, polystyrene, polytetrahydrofuran, polyvinyl alcohol, poly-N-vinylcarbazole, poly-1-vinylnaphthalene, poly-2-vinylnaphthalene, polyvinylbiphenyl, poly-2-vinylpyridine, polyphenylene oxide, polybutadiene, polybutene, polybutene oxide, polypropylene and resin film using these polymers as a raw material. Of these, a polyethylene terephthalate (PETP) resin film is most preferred. A paper laminated with a resin selected from the above-described resins, namely, a so-called double coated laminate may also be used. In particular, a polyethylene-laminated paper is preferred. When a laminated paper is used, the paper support and the laminate resin are preferably not treated to have electrical conductivity in view of the production cost, durability and the like.

The support preferably has a resistivity of more than $1\times10^{10}$ Ω.cm, preferably $1\times10^{11}$ Ω.cm or more. The upper limit thereof is not particularly limited, however, it is usually $1\times10^{17}$ Ω.cm or less. By having a resistivity of more than $1\times10^{10}$ Ω.cm, a discharge phenomenon occurs in the atmosphere between the electrically conductive layer and an electric conductor described later at the corona discharging from the photoconductive layer side and electrostatic charging can be smoothly performed. In other words, the electrification time can be reduced. The thickness of the support is preferably from 75 to 200 μm, more preferably from 120 to 180 μm, still more preferably about 150 μm. If the thickness of the support is too large, an intensified discharge breakdown phenomenon readily takes place on a part of the support and the photoconductive layer may lose the solute by burning. On the other hand, if the thickness of the support is too small, the support is deficient in the required strength, durability and the like. The above-described construction materials themselves have water resistance.

In the case of using a laminated paper, the paper support has a thickness of from 50 to 150 μm, preferably from 65 to 146 μm, and the laminate resin has a thickness of from 15 to 30 μm. preferably 27 μm when the paper has a thickness of 146 μm, or 19 μm when the paper has a thickness of 65 μm. In order to improve adhesion between the laminate layer and the paper support, it is preferred to previously coat a polyethylene derivative such as on ethylene vinyl acetate copolymer, an ethylene-acrylic ester copolymer, an ethylene-methacrylic ester copolymer, an ethylene-acrylic acid copolymer, an ethylene-methacrylic acid copolymer, an ethylene-acrylonitrile-acrylic acid copolymer or an ethylene-acrylonitrile-methacrylic acid copolymer, on the support or apply corona discharge treatment to the surface of the support. Furthermore, the support may be subjected to surface treatment described in JP-A-49-24126, JP-A-52-36176, JP-A-52-121683, JP-A-53-2612, JP-A-54-111331 and JP-B-51-25337.

The electrically conductive layer provided on the support has a resistivity of $1\times10^{5}$ Ω.cm or less, preferably $1\times10^{4}$ Ω.cm or less, more preferably $1\times10^{3}$ Ω.cm or less. The lower limit is not particularly limited, however, it is usually about $1\times10^{2}$ Ω.cm. The construction material having a resistivity of $1\times10^{5}$ Ω.cm or less is not particularly limited, however, examples thereof include those comprising the above-described resin material as the binder having added thereto an electrically conducting agent to have a resistivity within the specified range. Examples of the electrically conducting agent include carbon black, colloidal silica, colloidal alumina, metals such as aluminum, zinc, silver, iron, copper, titanium, manganese, cobalt and palladium, and their salt (e.g., chloride, oxide, bromide, sulfate, nitrate and oxalate), alkyl phosphate, alkanolamine salt, polyoxyethylene alkyl phosphate, polyoxyethylene alkyl ether, alkylmethylammonium salt, N,N-bis(2-hydroxyethyl) alkylamine, alkyl sulfonate, alkylbenzenesulfonate, fatty acid choline ester, its phosphate and a salt thereof, fatty acid monoglyceride, and fatty acid sorbitan partial ester; cation-type polyelectrolytes including primary, secondary and tertiary ammonium salts such as polyethyleneimine hydrochloride and poly(N-methyl-4-vinylpyridium chloride), quaternary ammonium salts such as poly(2-methacryloxyethyltrimethylammonium chloride), poly(2-hydroxy-3-methacryloxypropyltrimethylammonium chloride), poly(N-acrylamidopropyl-3-trimethylammonium chloride), poly(N-methylvinylpyridium chloride), poly(N-vinyl-2,3-dimethylimidazolinium chloride), poly (diallylammonium chloride) and poly(N,N-dimethyl-3,5-methylenepiperidinium chloride), sulfoniums such as poly (2-acryloxyethyldimethylsulfonium chloride), and phosphoniums such as poly(glcidyltributylphosphonium chloride; and anion-type polyelectrolytes including carboxylates such as poly(meth)acrylic acid, polyacrylic ester hydrolysate, polyacrylic amide hydrolysate and polyacrylic nitrile hydrolysate, sulfonates such as polystyrene sulfonate and polyvinylsulfonate, and phosphonates such as polyvinyl phosphonate.

By using an electrically conductive layer comprising the above-described binder and electrically conducting agent, coating thereof on a support is facilitated, the volume resistivity can be controlled, and the lithographic printing plate precursor obtained is easy to handle. The electrically conductive layer preferably comprises a styrene butadiene copolymer or acryl-base resin having added thereto carbon black or electrically conductive titanium oxide whiskers.

The thickness of the electrically conductive layer varies depending on the construction material used, the electrically conducting agent added or the amount thereof, however, it is in general preferably from 0.5 to 10 $\mu$m, more preferably from 2 to 5 $\mu$m. The electrically conducting agent usually has a particle size of from 0.01 to 5 $\mu$m, and the content thereof is usually on the order of from 3 to 11 wt %.

The electrically conductive layer may be provided on a support by bonding or coating. In the case where the above-described resin material having added thereto an electrically conducting agent is applied to a support, a coating method is preferred. The coating method which can be used includes usual methods such as bar coatings roll coating such as gravure and reverse, doctor knife coating, air knife coating and nozzle coating. When the adhesion between the support and the electrically conductive layer is poor, the support surface may be subjected to corona discharge treatment or chemical pretreatment. Furthermore, in order to improve adhesion between the support and the electrically conductive layer, an intermediate layer may be provided.

Between the electrically conductive layer and the photoconductive layer, a blocking layer is preferably provided. The blocking layer has an action of preventing transfer of electric charges and/or electrons and is effective in improving the electrification efficiency and preventing uneven electrification and the like. As the blocking agent, a resin capable of forming a uniform film and suitable for the blocking layer is appropriately selected from the above-described resins for the electrically conductive layer. Of these resins, polymethyl methacrylate and polyacrylonitrile are preferred and a solution thereof is coated and dried to form the blocking layer.

The blocking layer preferably has a resistivity of $1\times10^{10}$ Ω.cm or more, more preferably $1\times10^{11}$ Ω.cm or more. The upper limit thereof is not particularly limited, however, it is usually about $1\times10^{14}$ Ω.cm. The thickness of the blocking layer is usually on the order of from 0.2 to 2 $\mu$m. The blocking layer may be provided on the electrically conductive layer using the same means as described above for the electrically conductive layer.

The photoconductive layer may be a photoconductive layer commonly used for lithographic printing plate precursors In the electrophotographic system and one obtained by dispersing zinc oxide (ZnO) in a binder is usually used.

The particle size of zinc oxide in usual is approximately from 0.1 to 0.5 $\mu$m. The binder is not particularly limited and a binder commonly used and having good mechanical and electric properties may be used. Examples of such a binder include polystyrene, polyacrylic or polymethacrylic ester, polyvinyl acetate, polyvinyl chloride, polyvinyl butyral and derivatives thereof, polyester resin, acrylic resin, epoxy resin and silicone resin. Of these, acrylic resin is preferred. The mixing ratio by weight of the pigment (ZnO) and binder is usually on the order of from 3:1 to 20:1. The photoconductive layer thus constructed is usually coated in an amount of approximately from 15 to 30 g/m$^2$. The thickness of the photoconductive layer is preferably from 5 to 30 $\mu$m. The photoconductive layer may be provided on the blocking layer or on the electrically conductive layer by the same means as described above for the electrically conductive layer On the surface of the support opposite to the photoconductive layer, a backcoat layer may be provided. The backcoat layer has a function of preventing slipping or in some cases, controlling the electrical conductivity. The backcoat layer is obtained by uniformly dispersing the above-described electrically conducting agent and particles (particle size: approximately from 0.1 to 1 $\mu$m) for controlling the rigidity in a polymer binder.

Examples of the polymer for this binder include polyethylene, polybutadiene, polyacrylic ester, polymethacrylic ester, polyamylose acetate, nylon, polycarbonate, polyvinyl formate, polyvinyl acetate, polyacenaphthylene, polyisoprene, polyethylene, polyethylene terephthalate, polyvinyl chloride, polyoxyethylene, polypropylene oxide, polytetrahydrofuran, polyvinyl alcohol, polyphenylene oxide, polypropylene, copolymers thereof, and cured products of gelatin, polyvinyl alcohol or the like.

An example of the construction of a lithographic printing plate according to the present invention is described below by referring to the drawing attached hereto.

FIG. 1 is a conceptual view showing an example of the construction of a lithographic printing plate according to the present invention. In FIG. 1, a lithographic printing plate precursor comprises a support 2 having provided thereon in sequence an electrically conductive layer 3, a blocking layer 4 and a photoconductive layer 5. The photoconductive layer 5 electrostatically charged by a predetermined operation in exposed and developed to form a toner image 6 and after degreasing (etching) treatment, a lithographic printing plate Is obtained.

Figure 2:
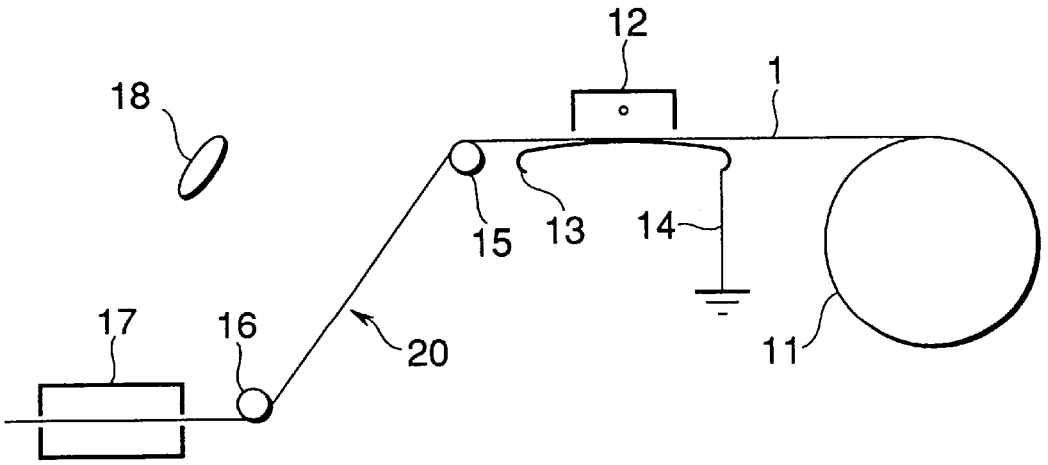
FIG. 2 is a conceptual view showing a process (apparatus) for producing a lithographic printing plate according to the present invention.

The production process of a lithographic printing plate of the present invention is described below. FIG. 2 shows a conceptual view showing the process (apparatus) for producing a lithographic printing plate. In FIG. 2, a lithographic printing plate precursor (hereinafter referred to as a "master") 1 is fed from the paper feeding part 11 by a transportation means and earthed by a negative corona charger 12 and a conductor 14 and the upper portion and the lower portion of the photoconductive layer 3 are electrostatically charged to − and +, respectively, by an electric conductor 13 having an earth potential. The electric conductor 13 contacts with the support 2 of the master 1 to act as an earth electrode and at the same time functions as a transportation guide therefor. More specifically, since the support 2 has a volume resistivity of more than $1\times1\text{-}^{10}$ Ω.cm, the electrically conductive layer 3 is nearly electrically insulated from the electric conductor 13. However, when the negative corona charger 12 works, an atmospheric discharge phenomenon occurs due to the short distance from the electric conductor 13 to the electrically conductive layer 3 corresponding to the thickness of the support 2, and thereby the master 1 is electrostatically charged. Preferred examples of the electric conductor 13 include metals such as iron, copper and aluminum, alloys such as stainless steel, these metals and alloys surface-treated with nickel, chromium or the like, carbon resins, and resin materials having incorporated thereinto an electrically conductive substance, each having a volume resistivity of $1\times10^3$ Ω.cm or less. The thickness of the electric conductor is appropriately determined according to the construction material or the construction of the plate-making apparatus, however, it is usually on the order of from 0.1 to 5 mm. The dimension of the electric conductor may also be determined according to the dimension of the corona charger or master 1.

The voltage applied to the corona charger is preferably from −4 to −10 KV, more preferably from −5.5 to −6.5 KV. The master (electrophotographic lithographic printing plate precursor) 1 is preferably passed under the corona charger at a rate of from 1 to 50 cm/sec, more preferably from 5 to 20 cm/sec.

The master 1 is then imagewise exposed by an exposure image such as laser ray or incandescence converged by a leas 18 at the exposure part 20 between two guide rollers 15 and 16. As a result, electric charges in the exposure area disappear and electric charges remain only in the unexposed area. The exposed master 1 is transported to the development/fixing part 17 by a transportation means, developed by attaching toner to the non-exposed area, fixed, hydrophilized and dried to manufacture a lithographic printing plate. The toner used is usually a liquid toner.

Zinc oxide is degreased using a degreasing solution and for this purpose, a cyan compound-containing processing solution mainly comprising ferrocyanate or ferricyanate, a cyan-free processing solution mainly comprising an amine cobalt complex, phytic acid or a derivative thereof, or a guanidine derivative, a processing solution mainly comprising an inorganic acid or organic acid capable of chelating with zinc ion, and a processing solution containing a water-soluble polymer are known.

Examples of the cyan compound-containing processing solution include those described in JP-B-44-9045, JP-B-46-39403, JP-A-52-76101, JP-A-57-107889 and JP-A-54-117201.

Examples of the processing solution containing a phytic acid-base compound include JP-A-53-83807, JP-A-53-83805, JP-A-53-102102, JP-A-53-109701, JP-A-53-127003, JP-A-54-2803 and JP-A-54-44901.

Examples of the processing solution containing a metal complex-base compound such as cobalt complex include JP-A-53-104301, JP-A-53-140103, JP-A-54-18304 and JP-B-43-28404.

Examples of the inorganic or organic acid-containing processing solution include those described in JP-B-39-13702, JP-B-40-10308, JP-B-43-28408, JP-B-40-26124, JP-A-51-118501 .

Examples of the guanidine compound-containing processing solution include those described in JP-A-56-111695.

Examples of the processing solution containing a water-soluble polymer include those described in JP-A-52-126302, JP-A-52-134501, JP-A-53-49506, JP-A-53-59502, JP-A-53-104302, JP-B-38-9665, JP-B-39-22263, JP-B-40-763, JP-B-40-2202 and JP-A-49-36402.

It is considered that in the degreasing treatment using any of the above-described processing solutions, zinc oxide in the surface layer is ionized into zinc ion, this ion causes a chelating reaction with a compound capable of forming a chelate present in the degreasing solution, and the zinc chelated product precipitates in the surface layer, thereby hydrophilizing the surface layer.

The degreasing treatment is usually performed at room temperature (on the order of from 15 to 35° C.) for approximately from 0.5 to 30 seconds. The printing plate obtained can allow off-set printing of about 3,000 sheets using a fountain solution.

Figure 3:
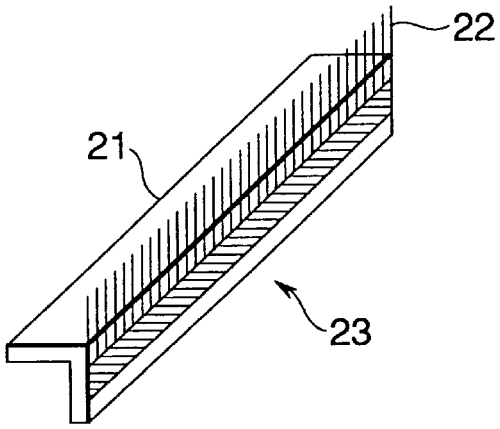
FIG. 3 is a perspective sketch view showing an example of the structure of an auxiliary electric conductor used in combination of an electric conductor.

The electrostatic charging may also be performed by using a brush or brush conductor earthed in the came manner as the electrical conductor 13 in combination with the electric conductor 13. The brush or brush conductor is disposed before and/or after the corona charger 12 or the electric conductor 13 and directly contacted with the electrically conductive layer 3. More specifically, as shown in FIG. 3, a brush 22 is formed by erecting many conductor fibers or sticks on a metal-made support 21 and used as an auxiliary electric conductor 23. This auxiliary electric conductor may be contacted with the side surface of the master 1 or electrically conductive fibers may be erected on the entire surface of the electric conductor at a high density. These are advantageous in that electrostatic charging can be smoothly performed without having any limitation from the thickness of the support 2, the transportation speed can be increased and uneven charging can be reduced.

The present invention is described in greater detail below by referring to the Examples, however, the present invention should not be construed as being limited thereto.

EXAMPLE 1

Preparation of Electrically Conductive Layer

One surface of a polyethylene terephthalate film having a thickness of 125 μm and a volume resistivity of $2\times10^{15}$ Ω.cm was subjected to corona discharging treatment. On this surface, an electrically conductive layer was formed using Dispersion Coating Solutions D1 to D10 having Composition 1 shown below by varying the amount of carbon black added to have a volume resistivity shown in Table 1. The electrically conductive layer was coated by a wire bar to have a dry coated amount of 7 g/m$^2$ and dried in an atmosphere of 120° C. for 1 minute to obtain Sample Nos. D1 to D10.

Composition 1

| | |
|---|---|
| Styrene butadiene latex (solids content: 50 wt %) | 100 parts by weight |
| Carbon black (average Particle size: 25 μm) | 0 to 11 parts by weight |
| Clay (aqueous dispersion solution having solids content of 45 wt %) | 100 parts by weight |
| Water | 35 parts by weight |
| Melamine | 3 parts by weight |

Preparation of Blocking Layer

Then, a blocking layer was formed using a dispersion solution having Composition 2 shown below by varying the amounts of vinylbenzyl quaternary ammonium and carbon black added as the water-soluble electrically conducting agents to have a volume resistivity shown in Table 2. The blocking layer was coated by a wire bar to have a dry coated amount of 3 g/m$^2$ and dried in an atmosphere of 120° C. for 1 minute to obtain Sample Nos. B1 to B5.

Composition 2

| | |
|---|---|
| Styrene butadiene latex (solids content: 50 wt %) | 30 parts by weight |
| Starch | 1 part by weight |
| Carbon black (average particle size: 25 μm) | 0 to 6 parts by weight |
| Vinylbenzyl quaternary ammonium (10 wt % aqueous solution) | 0 to 20 parts by weight |
| Clay (aqueous dispersion solution having solids content of 45 wt %) | 100 parts by weight |
| Water | 90 parts by weight |

The volume resistivities of the electrically conductive layer and the blocking layer were determined as follows.

Each of the solutions having respective compositions was coated on a stainless steel sheet having the same thickness as the sample and dried, and thereon gold was deposited in the form of a circle having a diameter of 10 cm. The electric resistance between the stainless steel sheet and the gold deposited film was measured and from the thickness of the layer and the area of the gold deposited film, the volume resistivity was calculated. The results obtained are shown in Tables 1 and 2 below.

TABLE 1

| Sample No. | Volume Resistivity (Ω · cm) |
|---|---|
| D1 | $1.1 \times 10^2$ |
| D2 | $3.9 \times 10^2$ |
| D3 | $6.3 \times 10^2$ |
| D4 | $9.2 \times 10^3$ |
| D5 | $2.1 \times 10^3$ |
| D6 | $8.4 \times 10^3$ |
| D7 | $4.2 \times 10^4$ |
| D8 | $5.5 \times 10^5$* |
| D9 | $1.3 \times 10^6$* |
| D10 | $7.4 \times 10^7$* |

*out of range

TABLE 2

| Sample No. | Volume Resistivity (Ω · cm) |
|---|---|
| B1 | $9.3 \times 10^{10}$ |
| B2 | $2.2 \times 10^{11}$ |
| B3 | $8.5 \times 10^{11}$ |
| B4 | $4.2 \times 10^{12}$ |
| B5 | $7.3 \times 10^{12}$ |

On each of 50 samples obtained by combining one of electrically conductive layer samples D1 to D10 with one of the blocking layer Samples B1 to B5 prepared above, a dispersion solution having composition 3 shown below for the photoconductive layer was uniformly coated by a wire bar to have a solids coated weight of 25 g/m$^2$, dried in an atmosphere of 100° C. for 1 minute and allowed to stand in a dark room kept at 20° C. and 60% RH for 24 hours to obtain lithographic printing plate precursor samples. The samples obtained each was subjected to the plate-making process using a plate-making machine ELP-330RX manufactured by Fuji Photo Film Co., Ltd. and images obtained were evaluated on the following four items. The print-making machine ELP-330RX uses a so-called single corona charging system of applying minus corona charge from the photosensitive (ZnO/binder) layer side on the master surface and contacting an earthed electric conductor with the back surface thereof to effect electrostatic charging, like the apparatus shown in FIG. 2.

Composition 3

| | |
|---|---|
| Photoconductive zinc oxide | 100 parts by weight |
| Acrylic resin | 20 parts by weight |
| Toluene | 125 parts by weight |
| Phthalic anhydride | 0.1 part by weight |
| Rose Bengal (4% methanol solution) | 4.5 parts by weight |

(1) Reflection Density of Solid Part

The reflection density of the solid part was measured by a Macbeth reflection densitometer (Model RD-517). The solid reflection density is preferably 1.00 or more.

(2) Non-Image Fog ($D_{fog}$)

Dfog was measured by a Macbeth reflection densitometer (Model RD-517). $D_{fog}$ is preferably 0.08 or less.

(3) Uneven Charging

The electrostatic charge was evaluated by the following criteria:

| | |
|---|---|
| Charging is uniform throughout the 15 cm-square solid part: | ○ |
| Uneven charging is slightly confirmed in the 15 cm-square solid part: | Δ |
| Uneven charging is clearly confirmed in the 15 cm-square solid part: | X |

(4) Sharpness of Image and Line

The sharpness was evaluated by the following criteria:

| | |
|---|---|
| All parts of a 10-point Ming-cho type character "長" (a chinese Character) are sharp and smooth: | ◎ |
| One part of a 10-point Ming-cho type character "長" is thick or thin: | ○ |
| More than one part of a 10-point Ming-cho type character "長" are thick or thin: | Δ |
| One or more parts of a 10-point Ming-cho type character "長" are lacked: | X |

The results obtained are shown in Tables 3 to 7.

TABLE 3

(Sample B1)

| Sample No. | Solid Reflection Density (Dm) | Non-Image Fog ($D_{fog}$) | Uneven Charging | Image Sharpness |
|---|---|---|---|---|
| D1 | 0.95 | 0.07 | ○ | ◎ |
| D2 | 0.95 | 0.07 | ○ | ◎ |
| D3 | 0.95 | 0.08 | ○ | ◎ |
| D4 | 0.96 | 0.08 | ○ | ◎ |
| D5 | 0.96 | 0.08 | ○ | ◎ |
| D6 | 0.97 | 0.08 | ○ | ◎ |
| D7 | 0.98 | 0.08 | ○ | ◎ |
| D8* | 0.98 | 0.11 | ○ | ◎ |
| D9* | 0.96 | 0.15 | ○ | ◎ |
| D10* | 0.96 | 0.19 | ○ | ◎ |

*out of the range

TABLE 4

(Sample B2)

| Sample No. | Solid Reflection Density (Dm) | Non-Image Fog ($D_{fog}$) | Uneven Charging | Image Sharpness |
|---|---|---|---|---|
| D1 | 1.01 | 0.08 | ○ | ◎ |
| D2 | 1.01 | 0.08 | ○ | ◎ |
| D3 | 1.00 | 0.08 | ○ | ◎ |
| D4 | 1.00 | 0.08 | ○ | ◎ |
| DS | 1.01 | 0.08 | ○ | ◎ |
| D6 | 1.01 | 0.08 | ○ | ◎ |
| D7 | 1.01 | 0.08 | ○ | ◎ |
| D8* | 1.00 | 0.10 | ○ | ◎ |
| D9* | 0.98 | 0.15 | ○ | ◎ |
| D10* | 0.96 | 0.26 | ○ | ◎ |

*out of the range

TABLE 5

(Sample B3)

| Sample No. | Solid Reflection Density (Dm) | Non-Image Fog ($D_{fog}$) | Uneven Charging | Image Sharpness |
|---|---|---|---|---|
| D1 | 1.01 | 0.08 | ○ | ◎ |
| D2 | 1.01 | 0.08 | ○ | ◎ |
| D3 | 1.01 | 0.07 | ○ | ◎ |
| D4 | 1.01 | 0.08 | ○ | ◎ |
| D5 | 1.00 | 0.08 | ○ | ◎ |
| D6 | 1.00 | 0.08 | ○ | ◎ |
| D7 | 1.00 | 0.08 | ○ | ◎ |
| D8* | 0.99 | 0.13 | ○ | ◎ |
| D9* | 0.99 | 0.17 | ○ | ◎ |
| D10* | 0.97 | 0.29 | ○ | ◎ |

*out of the range

TABLE 6

(Sample B4)

| Sample No. | Solid Reflection Density (Dm) | Non-Image Fog ($D_{fog}$) | Uneven Charging | Image Sharpness |
|---|---|---|---|---|
| D1 | 1.00 | 0.08 | ○ | ◎ |
| D2 | 1.00 | 0.08 | ○ | ◎ |
| D3 | 1.00 | 0.08 | ○ | ◎ |
| D4 | 1.01 | 0.08 | ○ | ◎ |
| D5 | 1.01 | 0.08 | ○ | ◎ |
| D6 | 1.01 | 0.08 | ○ | ◎ |
| D7 | 1.01 | 0.09 | ○ | ◎ |
| D8* | 0.99 | 0.14 | ○ | ◎ |
| D9* | 0.99 | 0.19 | ○ | ◎ |
| D10* | 0.97 | 0.33 | ○ | ◎ |

*out of the range

TABLE 7

(Sample B5)

| Sample No. | Solid Reflection Density (Dm) | Non-Image Fog ($D_{fog}$) | Uneven Charging | Image Sharpness |
|---|---|---|---|---|
| D1 | 1.01 | 0.08 | ○ | ◎ |
| D2 | 1.00 | 0.08 | ○ | ◎ |
| D3 | 1.00 | 0.08 | ○ | ◎ |
| D4 | 1.01 | 0.08 | ○ | ◎ |
| D5 | 1.02 | 0.08 | ○ | ◎ |
| D6 | 1.01 | 0.08 | ○ | ◎ |

TABLE 7-continued (Sample B5)

| Sample No. | Solid Reflection Density (Dm) | Non-Image Fog ($D_{fog}$) | Uneven Charging | Image Sharpness |
|---|---|---|---|---|
| D7 | 1.02 | 0.09 | ○ | ◎ |
| D8* | 0.99 | 0.15 | ○ | ◎ |
| D9* | 0.98 | 0.22 | ○ | ◎ |
| D10* | 0.97 | 0.34 | ○ | ◎ |

*out of the range

EXAMPLE 2

Using samples of Example 1, plate-making was performed in the apparatus of Example 1 shown in FIG. 2 where an auxiliary electric conductor shown in FIG. 3 was used in combination. On comparison with the results in Example 1, the printing property was more improved.

EXAMPLE 3

Print-making and evaluation were performed in the same manner as in Examples 1 and 2 except that a double-laminated paper (volume resistivity: $4\times10^{11}$ Ω.cm) having a paper thickness of 146 μm and a polyethylene laminate resin thickness of 27 μm was used in place of a 125 μm-thick polyethylene terephthalate film used in Example 1. The results obtained were the same as those in Examples 1 and 2.

EXAMPLE 4

Print-making and evaluation were performed in the same manner as in Examples 1 and 2 except that a double-laminated paper (volume resistivity: $2.8\times10^{10}$ Ω.cm) having a paper thickness of 65 μm and a polyethylene laminate resin thickness of 19 μm was used in place of a 125 μm-thick polyethylene terephthalate film used in Example 1. The results obtained were the same as those in Examples 1 and 2.

COMPARATIVE EXAMPLE 1

Figure 4:
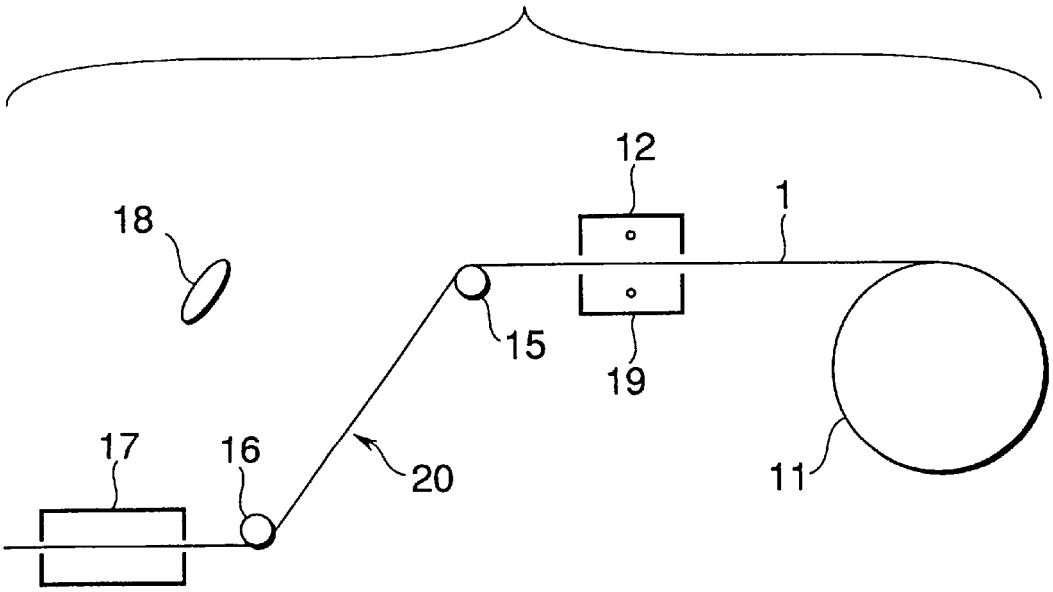
FIG.4 PRIOR ART
FIG. 4 is a conceptual view showing a conventional process (apparatus) for producing a lithographic printing plate.

The same lithographic printing plate precursor samples as used in Example 1 were subjected to the print making process in a print-making machine ELP-404V manufactured by Fuji Photo Film Co., Ltd., and the images obtained were evaluated in the same manner as in Example 1. The print-making machine ELP-404V used here employed a so-called double corona charging system of applying minus corona charge from the photosensitive (ZnO/binder) layer side on the master surface and applying plus corona charge from the back surface thereof like the apparatus shown in FIG. 4.

The results obtained are shown in Tables 8 to 12.

TABLE 8

(Sample B1)

| Sample No. | Solid Reflection Density (Dm) | Non-Image Fog ($D_{fog}$) | Uneven Charging | Image Sharpness |
|---|---|---|---|---|
| D1 | 0.95 | 0.14 | X | Δ |
| D2 | 0.94 | 0.14 | X | Δ |
| D3 | 0.94 | 0.15 | X | Δ |
| D4 | 0.96 | 0.16 | X | Δ |

TABLE 8-continued (Sample B1)

| Sample No. | Solid Reflection Density (Dm) | Non-Image Fog ($D_{fog}$) | Uneven Charging | Image Sharpness |
|---|---|---|---|---|
| DS | 0.96 | 0.18 | X | Δ |
| D6 | 0.98 | 0.18 | X | Δ |
| D7 | 0.98 | 0.22 | X | Δ |
| D8* | 0.98 | 0.26 | X | Δ |
| D9* | 0.97 | 0.33 | X | X |
| D10* | 0.96 | 0.39 | X | X |

*out of the range

TABLE 9

(Sample B2)

| Sample No. | Solid Reflection Density (Dm) | Non-Image Fog ($D_{fog}$) | Uneven Charging | Image Sharpness |
|---|---|---|---|---|
| D1 | 0.95 | 0.12 | X | Δ |
| D2 | 0.95 | 0.13 | X | Δ |
| D3 | 0.97 | 0.15 | X | Δ |
| D4 | 0.97 | 0.15 | X | Δ |
| D5 | 0.99 | 0.17 | X | Δ |
| D6 | 0.99 | 0.18 | X | Δ |
| D7 | 0.98 | 0.22 | X | Δ |
| D8* | 0.97 | 0.27 | X | X |
| D9* | 0.96 | 0.33 | X | X |
| D10* | 0.96 | 0.41 | X | X |

*out of the range

TABLE 10

(Sample B3)

| Sample No. | Solid Reflection Density (Dm) | Non-Image Fog ($D_{fog}$) | Uneven Charging | Image Sharpness |
|---|---|---|---|---|
| D1 | 0.96 | 0.13 | X | Δ |
| D2 | 0.98 | 0.13 | X | Δ |
| D3 | 0.98 | 0.15 | X | Δ |
| D4 | 0.98 | 0.18 | X | Δ |
| D5 | 0.99 | 0.21 | X | Δ |
| D6 | 0.98 | 0.22 | X | Δ |
| D7 | 0.97 | 0.27 | X | Δ |
| D8* | 0.96 | 0.31 | X | X |
| D9* | 0.96 | 0.35 | X | X |
| D10* | 0.96 | 0.44 | X | X |

*out of the range

TABLE 11

(Sample B4)

| Sample No. | Solid Reflection Density (Dm) | Non-Image Fog ($D_{fog}$) | Uneven Charging | Image Sharpness |
|---|---|---|---|---|
| D1 | 0.97 | 0.13 | X | Δ |
| D2 | 0.98 | 0.15 | X | Δ |
| D3 | 0.99 | 0.16 | X | Δ |
| D4 | 0.98 | 0.19 | X | Δ |
| D5 | 0.98 | 0.23 | X | Δ |
| D6 | 0.98 | 0.25 | X | Δ |
| D7 | 0.98 | 0.31 | X | X |
| D8* | 0.97 | 0.37 | X | X |
| D9* | 0.97 | 0.44 | Δ | X |
| D10* | 0.97 | 0.51 | Δ | X |

TABLE 11-continued (Sample B4)

| Sample No. | Solid Reflection Density (Dm) | Non-Image Fog ($D_{fog}$) | Uneven Charging | Image Sharpness |
|---|---|---|---|---|

*out of the range

TABLE 12

(Sample B5)

| Sample No. | Solid Reflection Density (Dm) | Non-Image Fog ($D_{fog}$) | Uneven Charging | Image Sharpness |
|---|---|---|---|---|
| D1 | 1.00 | 0.13 | X | Δ |
| D2 | 1.00 | 0.17 | X | Δ |
| D3 | 0.99 | 0.19 | X | Δ |
| D4 | 0.98 | 0.23 | X | Δ |
| D5 | 0.99 | 0.31 | X | X |
| D6 | 0.99 | 0.39 | X | X |
| D7 | 0.97 | 0.42 | X | X |
| D8* | 0.98 | 0.44 | X | X |
| D9* | 0.97 | 0.51 | Δ | X |
| D10* | 0.97 | 0.57 | Δ | X |

*out of the range

EXAMPLE 5

Ten lithographic printing plate precursor samples using electrically conductive layer Samples D1 to D10 were prepared in the same manner as in Example 1, except that no blocking layer was provided.

The samples obtained each was subjected to the plate-making process using plate-making machines ELP-330RX and ELP-404V, and the image obtained were evaluated in the same manner as in Example 1.

The results obtained by using ELP-330RX were the same as those shown in Table 3, except that a small white spot was barely observed on the solid part by naked eyes. Further, the results obtained by using ELP-404V were also the same as those shown in Table 8, except that a small white spot was barely observed on the solid part by naked eyes.

According to the present invention, a production process of a lithographic printing plate which can dispense with electrically conductive treatment and is inexpensive, free of plate elongation, easy to handle and capable of obtaining a uniform image due to the absence of uneven charging, can be provided.

While the invention has been described in detail and with reference to specific embodiments thereof, it will be apparent to one skilled in the art that various changes and modifications can be made therein without departing from the spirit and scope thereof.

What is claimed is:

1. A process for producing a lithographic printing plate using a lithographic printing plate precursor comprising a support having a volume resistivity of more than $1\times10^{10}$ Ω.cm, an electrically conductive layer provided on one surface of the support and having a volume resistivity of $1\times10^{5}$ Ω.cm or less and a photoconductive layer provided on the electrically conductive layer and containing zinc oxide and a binder, said process comprising applying negative corona discharge to the lithographic printing plate precursor from the photoconductive layer side and at this discharging, contacting an electric conductor having an earth potential at least with the support of the lithographic printing plate precursor to electrostatically charge the photoconductive layer of said lithographic printing plate precursor.

2. The process according to claim 1, wherein the support is a polyethylene terephthalate resin film or a polyethylene-laminated paper.

3. The process according to claim 1, wherein the support has a resistivity of from $1\times10^{11}$ to $1\times10^{17}$ Ω.cm.

4. The process according to claim 1, wherein the electrically conductive layer has a resistivity of $1\times10^{4}$ Ω.cm or less.

5. The process according to claim 1, wherein the electrically conductive layer has a resistivity of from $1\times10^{2}$ to $1\times10^{3}$ Ω.cm.

6. The process according to claim 1, wherein the lithographic printing plate precursor further comprises a blocking layer between the electrically conductive layer and the photoconductive layer.

7. The process according to claim 6, wherein the blocking layer has a resistivity of from $1\times10^{10}$ to $1\times10^{14}$ Ω.cm.

8. The process according to claim 1, wherein the electric conductor having an earth potential has a volume resistivity of $1\times10^{3}$ Ω.cm or less.

* * * * *